US006743560B2

(12) United States Patent
Pickering et al.

(10) Patent No.: US 6,743,560 B2
(45) Date of Patent: Jun. 1, 2004

(54) TREATING COMPOSITION AND PROCESS FOR TONER FUSING IN ELECTROSTATOGRAPHIC REPRODUCTION

(75) Inventors: Jerry A. Pickering, Hilton, NY (US); Dinesh Tyagi, Fairport, NY (US); Pauline K. Wenzel, Fairport, NY (US)

(73) Assignees: Heidelberger Druckmaschinen AG, Heidelberg (DE); NexPress Solutions LLC, Rochester, NY (US)

( * ) Notice: Subject to any disclaimer, the term of this patent is extended or adjusted under 35 U.S.C. 154(b) by 125 days.

(21) Appl. No.: 10/109,535

(22) Filed: Mar. 28, 2002

(65) Prior Publication Data

US 2003/0186147 A1 Oct. 2, 2003

(51) Int. Cl.[7] ..... G03G 13/20
(52) U.S. Cl. ..... 430/124; 430/97
(58) Field of Search ..... 430/124, 97

(56) References Cited

U.S. PATENT DOCUMENTS

| | | | |
|---|---|---|---|
| 3,002,927 A | 10/1961 | Awe et al. | |
| 4,000,957 A | 1/1977 | Ruhland | |
| 4,029,827 A | 6/1977 | Imperial et al. | |
| 4,101,686 A | 7/1978 | Strella et al. | |
| 4,165,308 A | 8/1979 | Serlin | |
| 4,167,602 A | 9/1979 | Serlin | |
| 4,185,140 A | 1/1980 | Strella et al. | |
| 4,257,699 A | 3/1981 | Lentz | |
| 4,264,181 A | 4/1981 | Lentz et al. | |
| 4,272,179 A | 6/1981 | Seanor | |
| 4,859,550 A | 8/1989 | Gruber et al. | |
| 5,209,464 A | 5/1993 | Bermel et al. | |
| 5,392,105 A | 2/1995 | Moser | |
| 5,516,361 A | 5/1996 | Chow et al. | |
| 5,531,813 A | 7/1996 | Henry et al. | |
| 5,568,239 A | 10/1996 | Furukawa et al. | |
| 5,627,000 A | 5/1997 | Yamazaki et al. | |
| 5,639,549 A | 6/1997 | Fukunaga et al. | |
| 5,641,603 A | 6/1997 | Yamazaki et al. | |
| 5,781,840 A | 7/1998 | Chen et al. | |
| 5,783,719 A | 7/1998 | Sun et al. | |
| 6,045,961 A | 4/2000 | Heeks et al. | |
| 6,114,041 A | 9/2000 | Tan et al. | |
| 6,261,688 B1 * | 7/2001 | Kaplan et al. | 428/391 |
| 6,582,871 B2 * | 6/2003 | Pickering | 430/124 |
| 6,617,090 B2 * | 9/2003 | Pickering et al. | 430/124 |

OTHER PUBLICATIONS

*Silicon Compounds: Register and Review*, 5th Ed., R. Anderson et al. (Eds.), United Chemical Technologies, Inc., Bristol, PA, p. 280 (1991).

*Silicon, Germanium*, & *Tin Compounds, Metal Oxides, Metal Diketonates, Silicones*, Gelest, Inc., Tullytown, PA, p. 515 (1998).

Pickering et al., U.S. application No. 09/387,586, filed Aug. 31, 1999, abandoned.

* cited by examiner

*Primary Examiner*—John Goodrow

(57) ABSTRACT

A composition for combating toner marking, in the form of a particulate material dispersed in release agent.

43 Claims, 2 Drawing Sheets

TREATING COMPOSITION AND PROCESS FOR TONER FUSING IN ELECTROSTATOGRAPHIC REPRODUCTION

BACKGROUND OF THE INVENTION

1. Field of the Invention

The present invention relates to a composition comprising release agent and particulate material, for application to one or both of the fuser member and the substrate in toner fusing systems and processes. The present invention further relates to combating toner marking, by means of applying the composition as indicated to one or both of the fuser member and the substrate in toner fusing systems and processes.

2. Description of Background and other Information

Generally in electrostatographic reproduction, the original to be copied is rendered in the form of a latent electrostatic image on a photosensitive member. This latent image is made visible by the application of electrically charged toner.

The toner thusly forming the image is transferred to a substrate—also referred to as a receiver—such as paper or transparent film, and fixed or fused to the substrate. Where heat softenable toners—for example, comprising thermoplastic polymeric binders—are employed, the usual method of fixing toner to the substrate involves applying heat to the toner, once it is on the substrate surface, to soften it, and then allowing or causing the toner to cool. This application of heat in the fusing process is preferably at a temperature of about 90° C.–220° C.; pressure may be employed in conjunction with the heat.

A system or assembly for providing the requisite heat and pressure customarily includes a fuser member and a support member. The heat energy employed in the fusing process generally is transmitted to toner on the substrate by the fuser member. Specifically, the fuser member is heated; to transfer heat energy to toner situated on a surface of the substrate, the fuser member contacts this toner, and correspondingly also can contact this surface of the substrate itself. The support member contacts an opposing surface of the substrate.

Accordingly, the substrate can be situated or positioned between the fuser and support members, so that these members can act together on the substrate to provide the requisite pressure in the fusing process. In cooperating, preferably the fuser and support members define a nip, or contact arc, in which the substrate is positioned or resides, and/or through which the substrate passes. Also as a matter of preference, the fuser and support members are in the form of fuser and pressure rollers, respectively. Yet additionally as a matter of preference, one or both of the fuser and support members have a soft layer that increases the nip, to effect better transfer of heat to fuse the toner.

During the fusing process toner can be offset from the substrate to the fuser member. Toner thusly transferred to the fuser member in turn may be passed on to other members in the electrostatographic apparatus, or to subsequent substrates subjected to fusing.

Toner on the fusing member therefore can interfere with the operation of the electrostatographic apparatus and with the quality of the ultimate product of the electrostatographic process. This offset toner is accordingly regarded as contamination of the fuser member, and preventing or at least minimizing this contamination is a desirable objective.

Release agents can be applied to fusing members during the fusing process, to combat toner offset. These agents usually are or include polyorganosiloxanes, particularly polyorganosiloxane oils.

U.S. Pat. No. 5,781,840 states that wicking agents may be applied to fuser members to prevent toner offset, and teaches a wicking agent comprising an organopolysiloxane, and at least about $1 \cdot 10^{-6}$ weight percent of a metal compound. The organopolysiloxane has Si—H functional groups, and the metal compound is effective for promoting reaction between the organopolysiloxane Si—H functional groups, and reactive sites on the fuser member surface.

The metal compound in the wicking agent may comprise a metal salt, and the salt may be complexed with an organic ligand. The fuser member may have a polymeric surface layer comprising inert particulate filler, such as metal oxides like aluminum and tin oxides.

Use of talcum powder as a release agent is also known. U.S. Pat. No. 4,000,957 discusses dispensing this powder either onto the toner and paper before it reaches the fuser roller, or onto the fuser roller itself. Application of talcum powder to the fuser roller is indicated to be either simultaneously with, or subsequent to, application of a liquid release material. Only separate application of talcum powder and liquid release material, each from its own dispenser, is disclosed.

As to the indicated application of powder to toner and paper, this patent teaches use of a dispensing mechanism suitable for dispensing approximately 0.25 milligrams of talcum powder per square centimeter of toner image. This rate of application for particulate material translates into over 4 kilograms of particulate material for every 10,000 copies.

Employment of particulate material at this high a rate is undesirable for high speed copier-printer applications. If particulate material applied at this rate were used in the form of dispersion in a liquid medium, such as a liquid release agent, viscosity would be unacceptably high.

This patent also teaches a preferred size of 0.1 to 10 microns for the talcum powder. Because of this particle size range and the distribution, the stability of the dispersion in carrier media would not be high; particulate accordingly would tend to accumulate in the dispensing mechanism, and affect flow rate.

Once the desired toner-formed image is fixed in its intended location on a substrate, it may be subjected to contact by other surfaces that will cause displacement from the intended location. This displacement may be in the form of smearing and/or transfer to the contacting surface, and can be referred to as toner marking.

For instance, in the case of the substrate being a single sheet, it may be subjected to folding, mailing, or reprinting (either the same side or the back side of the sheet). Where it is one of several or one of hundreds of sheets, the sheets may be processed further by operations including, for example, sorting, binding, insertion of other media, character recognition, and booklet making. Any of these or similar operations can cause the toner-formed image to contact other surfaces and leave an objectionable mark, caused by the relocation of toner from its original place of deposition and fixation. This marking can appear on a variety of locations—e.g., the backside of another sheet, another portion of the same sheet (when folded), or some other surface that would be visible to the intended recipient of the material.

It is known that toner marking can be combated by a number of methods. Among these are including wax additives in the toner, increasing the toughness of the toner, adding release lubricants to the toner surface, and reducing the force of contact causing the toner marking.

In this regard, U.S. Pat. Nos. 4,165,308 and 4,167,602 disclose electrographic recording materials, and coating compositions therefor, to improve toner adhesion and reduce toner smear. U.S. Pat. No. 4,859,550 discloses polymeric alcohols and aliphatic hydrocarbons as additives against toner offsetting and image smearing. U.S. application Ser. No. 09/387,586, filed Aug. 31, 1999, discloses a fuser member having a silicone rubber fusing surface that incorporates a controlled particle size filler; this fuser member maintains a low surface roughness, which reduces the roughness of the fused toner image, thus reducing toner marking. U.S. Pat. No. 5,209,464 discloses a sheet feed apparatus with a scuff feeder device that minimizes high pressure points contributing to toner ruboff.

In modern operations, images may be processed at a later time on unrelated equipment. Accordingly, sheets bearing these images should be able to minimize marking in a variety of paper handling equipment.

As indicated, application of release agents can be employed as a measure against toner offset. These materials, usually in the form of polydimethylsiloxane oils, also are known to reduce toner marking for a brief period after application. And in fact, as compared with other means of combating toner marking in an electrostatographic system, the use of a release agent has the advantage of minimizing impact on other subsystems, because fusing is one of the last steps in electrostatographic processes. However, the oil is absorbed into the substrate relatively quickly, and therefore as a practical matter is ineffective for use in combating toner marking.

In the field of offset printing, contamination caused by the ink used to form the intended images is also a factor to be addressed. For instance, this type of contamination can interfere with a process where an offset printer is applying ink to a succession of sheets that are thereafter stacked. If the ink is still wet when the sheets exit the printing stage, then during stacking ink can be transferred from sheet to sheet.

One means for combating this contamination is by dusting the image side of the sheets, with a material such as corn starch, after they leave the printing stage and prior to their stacking. As the sheets go into the stacker, they pass underneath an air blower apparatus that performs the dusting, so that the thusly applied material lies between the stacked sheets.

However, this dusting procedure itself leads to possible problems, such as contamination of machinery by the dusted material. And particularly, this material can be a health hazard.

In this regard, the material used for dusting can become airborne, and take a long time to settle out. Particles which have a diameter larger than about 2.5 microns are blocked in the nasal passages, and do not reach the lungs, while particles smaller than about 0.5 microns have sufficient Brownian motion, so that they do not stick to the inside wall of the lungs, and are breathed out.

However, particles of about 0.5 microns to about 2.5 microns are small enough to reach the lungs, and will stay there when breathed in. Of the material used for dusting, it is the particles in this size range that present the health hazard.

SUMMARY OF THE INVENTION

It has been discovered that a carrier medium may be used for imparting—to the substrate surface, and particularly to toner residing thereon—an agent for acting against, or combating—e.g., preventing or prohibiting, or at least inhibiting, or lessening, or reducing—toner marking. In this regard, the invention pertains to a composition for combating toner marking. This composition can be referred to as a treating composition.

The treating composition is for application to toner residing on a substrate surface. It comprises particulate material and at least one carrier medium. Preferably, the particulate material is for combating contact between the toner and other surfaces. With the particulate material incorporated in the carrier medium, this material does not present the potential contamination or health hazard problems of the indicated dusting employed in offset printing.

The invention further pertains to a process for fusing toner, residing on a substrate surface, to the substrate surface. This process utilizes the treating composition as indicated, with the carrier medium comprising at least one release agent. The process comprises applying the treating composition to the surface of a fuser member, and contacting the toner with the fuser member surface bearing this composition.

The invention yet additionally pertains to a process for combating toner marking. This process comprises applying the treating composition, to the surface of toner previously fused to a substrate surface.

Preferably the particulate material of the treating composition comprises, or consists essentially of or consists substantially of, particles that are spherical, or at least near spherical, or at least essentially spherical or at least substantially spherical, in shape. Also as a matter of preference, the particulate material comprises, or consists essentially of or consists substantially of, particles that are uniform, or at least nearly uniform, or at least essentially uniform or at least substantially uniform, in size.

DESCRIPTION OF THE INVENTION

Figure 1:
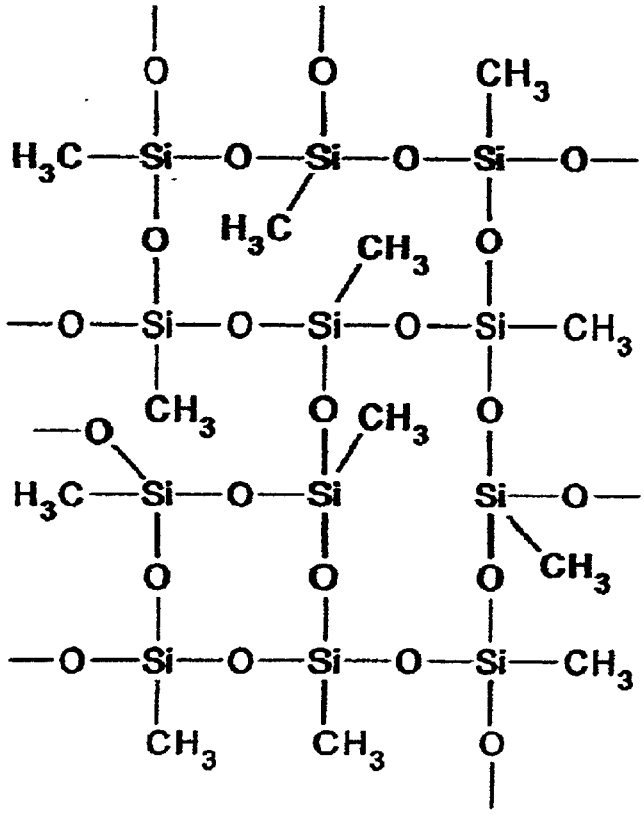
FIGS. 1–4 are idealized representations of the structures of different crosslinked random polyorgano-siloxanes suitable for the particulate material of the invention.

Copolymers are understood as including polymers incorporating two monomeric units, as well as polymers incorporating three or more different monomeric units, e.g., terpolymers, tetrapolymers, etc.

Polyorganosiloxanes are understood as including functional and nonfunctional polyorganosiloxanes. Polyorganosiloxanes further are understood as including polydiorganosiloxanes—i.e., having two organo groups attached to each, or substantially each, or essentially each, of the polymer siloxy repeat units. Polyorganosiloxanes yet further are understood as including polydimethylsiloxanes.

Functional polyorganosiloxanes are understood as being polyorganosiloxanes having functional groups on the backbone, or pendant groups on the polysiloxane portion, which can react with fillers present on the surface of the fuser member, or with a polymeric fuser member surface layer or component thereof. Functional polyorganosiloxanes further are understood as being polyorganosiloxanes having functional groups such as amino, hydride, halo (including chloro, bromo, fluoro, and iodo), carboxy, hydroxy, epoxy, isocyanate, thioether, and mercapto functional groups. Nonfunctional polyorganosiloxanes further are understood as being polyorganosiloxanes without groups of the type as indicated.

The term "organo" as used herein, such as in the context of polyorganosiloxanes, includes "hydrocarbyl", which includes "aliphatic", "cycloaliphatic", and "aromatic". The hydrocarbyl groups are understood as including the alkyl, alkenyl, alkynl, cycloalkyl, aryl, aralkyl, and alkaryl groups. Further, "hydrocarbyl" is understood as including both non-substituted hydrocarbyl groups, and substituted hydrocarbyl groups, with the latter referring to the hydrocarbyl portion bearing additional substituents, besides the carbon and hydrogen. Preferred organo groups for the polyorganosiloxanes are the alkyl, aryl, and aralkyl groups. Particularly preferred alkyl, aryl, and aralkyl groups are the $C_1$–$C_{18}$ alkyl, aryl, and aralkyl groups, particularly the methyl and phenyl groups.

It is understood that, although oils and liquids are discussed separately herein, oils nevertheless are considered also to be liquids, and the liquid form accordingly encompasses oils.

Particle size, particularly in the case of particulate material, is understood, unless stated otherwise, as referring to mean particle diameter.

It is understood that use conditions are those conditions, such as temperature, at which the treating composition is being manipulated—for instance, physically transferred—in conjunction with its employment for a process of the invention. In this regard, use conditions include the conditions under which the composition is depleted from its sump, or storage area, as well as conditions in the electrostatographic reproduction apparatus and system during operation, particularly fusing process conditions, and conditions under which the treating composition is being applied to the toner and/or substrate surface.

The composition of the invention is for application to toner residing on a substrate surface. This composition comprises at least one type of particulate material, and at least one carrier medium for the particulate material. Particularly, the composition comprises carrier medium incorporating the particulate material; the composition can be in the form of carrier medium with the particulate material incorporated therein. Preferably the particulate material is dispersed in the carrier medium.

In a first embodiment of the invention, the treating composition is employed in the same manner as release agents conventionally are used in toner fusing systems—preferably, during the fusing process. In this first embodiment, the carrier medium comprises a release agent.

In a second embodiment of the invention—alternatively or in addition to the treating composition being applied during the fusing process—the treating composition may be used in a step or process separate from the fusing process. Particularly, the treating composition may be applied to the surface of toner residing on the substrate, and/or to the substrate surface, after fusing has taken place.

Preferably in this second embodiment, the carrier medium is in liquid form when employed—particularly, in liquid form at the indicated application to toner and/or substrate. As a matter of particular preference, the carrier medium here is liquid at ambient—e.g., room—temperatures.

Suitable carrier media for this second embodiment include release agents. Preferred release agents are those that are liquid at ambient temperatures.

Release agents employed as carrier media in this second embodiment are being used in a step or process separate from the fusing process, and therefore they are not being used in the manner conventional for release agents. Nevertheless, for the purposes of this invention, materials that in fact are release agents still are referred to herein as release agents, even when employed as carrier media in this embodiment.

Carrier media appropriate for the composition of the invention include those that are liquid at ambient temperatures, and also those that are solid at ambient temperatures but liquid under use conditions. The latter, however—especially in the embodiment of the invention (i.e., the first embodiment) which is a toner fusing process, where the treating composition is applied to the fuser member surface, and the carrier medium comprises a release agent—require specialized delivery systems, as are known in the art.

Further as to release agents in particular, those suitable for the treating composition include those that are liquid at ambient temperatures. Appropriate release agents accordingly include release liquids, such as release oils. Release agents that are suitable also include those that are solid at ambient temperatures, but liquid at operating temperatures, particularly fusing process temperatures.

Preferably the carrier media, particularly in the case of release agents, are liquid at fusing process temperatures, and more preferably have an ambient temperature viscosity of from about 100 cp to about 500 cp or to about 100,000 cp, still more preferably from about 150 cp or from about 350 cp to about 100,000 cp, or from about 500 cp or from about 501 cp to about 10,000 cp, with the viscosity dropping at the elevated temperatures employed in the fusing process. Where carrier medium viscosity is discussed without indication of whether the ambient temperature liquids or solids are intended, then it is understood that in the case of the liquids the viscosity is ambient temperature viscosity, while for the solids it is viscosity at operating temperatures, particularly fusing process temperatures.

Additionally as a matter of preference, the carrier media of the invention—here also, particularly in the case of release agents—have a specific gravity (true density) of from about 0.7 gram/$cm^3$ to about 1.8 grams/$cm^3$. As with viscosity, where carrier medium density is discussed without indication of whether the ambient temperature liquids or solids are intended, then it is understood that in the case of liquids the density is ambient temperature density, while for solids it is density at operating temperatures, particularly fusing process temperatures.

Release agents which are preferred are the polymeric release agents, particularly polyorganosiloxanes, and more particularly polyorganosiloxane oils; silicone oils are particularly preferred. Polyorganosiloxanes which may be used include those endcapped by trimethylsiloxy groups.

Preferred polyorganosiloxanes are the nonfunctional polyorganosiloxanes, particularly the nonfunctional polydimethylsiloxanes. Commercially available nonfunctional polydimethylsiloxanes which may be used are the DC200 poly-dimethylsiloxanes, from Dow Corning Corporation, Midland, Mich.

Functional polyorganosiloxanes also may be used, such as those disclosed in U.S. Pat. Nos. 4,101,686 and 4,264,181; these patents are incorporated herein in their entireties, by reference thereto. One reason for employing functional polyorganosiloxanes is to enhance interaction of the release agent with the fuser member surface, or with material such as filler incorporated therein.

Among the suitable functional polyorganosiloxanes are fluorofunctional polyorganosiloxanes, including those with fluoroalkyl, such as trifluoroalkyl (e.g. trifluoropropyl) functionality, and fluorosilicones, and polyorganosiloxanes having fluorine-containing groups, as disclosed in U.S. Pat. Nos. 5,568,239, 5,627,000, and 5,641,603. These patents also are incorporated herein in their entireties, by reference thereto.

Suitable functional polyorganosiloxanes include those with one or more pendant functional groups and/or one or two terminating functional groups—it also being understood that pendant groups are side groups, or moieties attached along the backbone of the polymer chain, and terminating groups are end groups, or moieties attached at the polymer chain ends. Particularly preferred functional polyorganosiloxanes are the monofunctional polyorganosiloxanes—these being polyorgano-siloxanes having one functional group per molecule or polymer chain. Suitable monofunctional polyorganosiloxanes include those wherein the sole functional group is a side group; however, the preferred monofunctional polyorganosiloxanes are those which are functional group terminated—i.e., wherein the sole functional group is at an end of the polymer chain.

The treating composition of the invention may include both functional and nonfunctional polyorganosiloxanes, such as in the form of a blend of functional and nonfunctional polyorganosiloxanes. In this combination, a nonfunctional polyorganosiloxane may serve as a diluent for the functional compound, so as to lessen the release agent expense.

Phenyl group-bearing polyorganosiloxanes have greater temperature stability. Also, they are useful for using with other polyorganosiloxanes to modify release agent density. Suitable phenyl group-bearing polyorganosiloxanes include polyorganosiloxanes comprising phenylmethylsiloxane and dimethylsiloxane units, and polyphenylmethylsiloxanes.

It has been noted that release agents may be used as carrier media in the second embodiment of the invention as discussed—i.e., the embodiment in which the treating composition is employed in a step or process separate from the fusing process. However, where fusing temperatures are not employed for this embodiment, carrier media for the treating compositions used therein do not require the heat stability and low volatility that are necessary properties of release agents employed conventionally in fusing processes. Accordingly, carrier media other than release agents may be suitable for treating compositions used with the second embodiment of the invention.

In this regard, such carrier media include suitable synthetic and mineral hydrocarbon oils and liquid paraffin oils. Commercially available examples of these oils that may be used include the Isopar™ and Norpar™ fluids from Exxon Mobil Corporation, Houston, Tex.

Also suitable as carrier media for the indicated second embodiment are appropriate liquid polyethylenes. Commercially available examples of these that may be used include X-6007 from Baker Petrolite, Sand Springs, Okla., and Versaflow EV from Shamrock Technologies, Dayton, N.J.

Yet additionally, water can be a suitable carrier medium for this embodiment. Accordingly, treating compositions here include appropriate aqueous dispersions, comprising the particulate material in water.

The particulate material of the treating composition preferably is for combating toner marking. Particularly, as a matter of preference, the particulate material is for combating contact between toner and abrading surfaces. In this regard, where the treating composition is applied to toner on the substrate, this particulate material acts against toner marking by combating contact between the toner residing on a substrate surface, and other surfaces.

Such other surfaces can also be referred to as contacting surfaces, or, as indicated, abrading surfaces. These surfaces are the surfaces of any articles that come into contact with the indicated deposited toner. They include surfaces of other substrates, and surfaces of elements—e.g., machine parts, such as a roller, or a shoe—in the electrostatographic system. A contacting surface can also be a different portion of the same surface on which the toner resides. For instance, where the toner resides on a sheet of paper and this sheet is folded or bent, other parts of the same paper surface that may come into contact with the toner, due to the folding or bending, are understood as being such abrading surfaces.

The particulate material preferably is compatible with the carrier medium. There are different aspects to this compatibility.

One of these aspects is dispersibility. The particulate should be dispersible in the carrier medium. It should disperse on its own, or at least be dispersible by suitable means, such as mechanical mixing. Preferably, the particulate disperses evenly, or at least relatively evenly, through the carrier medium.

Another aspect of compatibility, for particulate material in the carrier medium, is resistance to agglomeration in the carrier medium (or to reagglomeration, where the particulate was originally in a clump or clumps that were broken up for dispersion), and accordingly to precipitation and phase separation. With the occurrence of agglomeration or reagglomeration, the resulting clumps are ineffective for the intended purpose of the particulate, and the material will settle more rapidly.

Where the particulate is wet by the carrier medium, then dispersibility as well as agglomeration (and reagglomeration) resistance are facilitated, while failure to wet results in clumping as discussed. In fact, because most materials are easily wet by polyorganosiloxane liquids, compatibility usually is not a problem with these carrier media.

As an exception, many fluorine containing materials in fact are not wet by the polyorganosiloxanes, unless the polyorganosiloxanes themselves have fluorofunctionality, or unless an additive is included to assist in the wetting. So where the particulate itself is fluorofunctional, or includes fluorine containing material—for instance, if a polytetrafluoroethylene particulate material, such as a Teflon powder, is used—then preferably a fluorofunctional polyorganosiloxane is employed. And the fluorosilicone can be used alone, or together with a nonfunctional polyorganosiloxane, as discussed; the fluorofunctional polyorganosiloxane can serve as an additive to the nonfunctional polyorganosiloxane, for facilitating the requisite dispersion.

Where the treating composition is for use by means of application to the fuser member, or otherwise is employed in the fusing process, then the particulate material should be heat stable at fusing process temperatures—e.g., within the range of from about 90° C., or about 120° C., or about 150° C., to about 200° C., or about 220° C., or about 250° C. Accordingly, for use in the fusing process, the particulate material preferably is heat stable up to at least about 90° C., more preferably up to at least about 120° C., still more preferably up to at least about 150° C., still more preferably up to at least about 200° C., still more preferably up to at least about 220° C., or even up to at least about 250° C.

As to the foregoing, heat stability entails the absence, or at least the essential absence or substantial absence, of degradation, decomposition, and release of byproducts, and of change in shape, size, or state of matter. Particularly, in being thusly heat stable, the particulate material undergoes no melting or sublimation, or essentially or substantially no melting or sublimation.

The particulate material may be in one or more of any suitable shapes—irregular, as well as in the form of spheroids, platelets, flakes, powders, ovoids, needles, fibers, and the like. Preferably the particles are uniform, or at least nearly uniform, or at least essentially uniform, or at least substantially uniform, in size. As a matter of particular preference, at least 50 percent, or at least about 50 percent, or a majority, or at least a majority, of the particles are uniform, or at least nearly uniform, or at least essentially uniform, or at least substantially uniform, in size.

Also as a matter of preference, the particles—or at least essentially all, or at least substantially all, or at least 50 percent, or at least about 50 percent, or a majority, or at least a majority, of the particles—have an aspect ratio of about 3 or less. This aspect ratio is still more preferably about 2 or less, still more preferably less about 1.5 or less, and still more preferably about 1, or 1. In this regard, a spherical or at least near spherical shape, or an essentially spherical or substantially spherical shape—or in the case of irregular particles, a shape tending more toward the spherical—is especially preferred.

At the aspect ratios as indicated—and particularly in the case of the spherical, or at least near spherical, or essentially spherical, or substantially spherical, shape—better flow properties are obtained. And this advantage is significant where the treating material is delivered by means employing a porous material, with the composition traveling through the pores; an example would be a rotating wick oiler. In systems using delivery of this type, clogging of the pores must be taken into consideration.

Particulate material with a high aspect ratio, or an elongated shape—e.g., in the form of fibers, or needles—are correspondingly not preferred with porous delivery systems as indicated. Elongated particles will tend to clog pores more easily, and they will increase the intrinsic viscosity of the treating composition.

As to densities suitable for the particulate material, very dense materials should be avoided. Preferably, the particulate material of the invention has a specific gravity of about 10 grams/cm$^3$ or less, more preferably about 5 grams/cm$^3$ or less. Still more preferably the specific gravity range for the particulate material is from about 0.5 gram/cm$^3$ to about 5 grams/cm$^3$, still more preferably from about 0.5 gram/cm$^3$ to about 2.7 grams/cm$^3$, still more preferably from about 0.5 gram/cm$^3$ to about 2.5 grams/cm$^3$, and still more preferably from about 0.7 gram/cm$^3$ to about 2.5 grams/cm$^3$.

Subject to factors as discussed, if the density of the particulate material is too much less than that of the carrier medium, then the particulate will float on the surface of the carrier medium in liquid form; correspondingly, if the particulate density is too much greater, it will sink and settle out. There is a range of difference that can be considered acceptable; if the density of the particulate material is not too much greater or too much less than that of the carrier medium, then maintenance of the dispersion will be at a satisfactory level.

Accordingly, the ratio of the particulate material specific gravity to the carrier medium specific gravity is preferably from about 0.5:1 to about 5:1, more preferably from about 0.5:1 to about 3.2:1, and still more preferably from about 0.7:1 to about 2.7:1. In this regard, for the purpose of keeping the particulate material dispersed within the carrier medium to the greatest extent possible, as a matter of particular preference the specific gravity of the particulate material is at least generally equivalent to that of the carrier medium.

And ideally, the particulate material and carrier medium will have the same specific gravity, or at least essentially the same specific gravity, or at least substantially the same specific gravity, or about the same specific gravity. This is particularly the case—in fact, it is required—where water, and where the specified oils and liquid polyethylenes as discussed herein, are employed as second embodiment carrier media, because of the generally lower viscosities of these media.

The particulate material preferably comprises micron sized particles, or particles that generally are micron sized. In this regard, as a matter of preference, the particulate material has a particle size of from about 0.1 microns to about 30 microns, more preferably from about 0.5 microns to about 12 microns, still more preferably from about 0.5 microns to about 6 microns. For particular circumstances the preferred size depends largely on factors which include carrier medium viscosity, the difference between the densities of the carrier medium and the particulate, and the roughness of the surface of the toner to which the treating composition is applied. Larger sizes are limited by the tendency for the particulate to settle out of the carrier medium. This will be a concern even for carrier media, particularly release agents, which are solid at ambient temperature, if they are maintained in liquid form—e.g., as a melt in a sump—during operation.

The time before dispersed particulate will settle out from suspension may be determined by the particle size of the particulate material, the carrier medium viscosity, and the difference between the specific gravities of the micron sized particulate and the carrier medium. The terminal velocity of the particulate can be determined by the buoyancy and drag forces if the particulate is a sphere, according to the equation $$4/3_{\pi}R^3\rho_s G-4/3_{\pi}R^3\rho_f G=6_{\pi\mu}v_t R \qquad \text{(Equation 1)}$$

where

R=particle radius $\rho_s$=particle density $\rho_f$=carrier medium density $\mu$=carrier medium viscosity $v_t$=settling velocity G=gravitational constant Thus, as the density difference between the particulate and the carrier medium decreases, the settling velocity decreases proportionally. The carrier medium viscosity is inversely proportional to the settling velocity, slowing the settling rate as the viscosity increases. The rate of settling increases as the square of the particle radius of the particulate material, however, indicating a high sensitivity to particle size.

At very small sizes, typically less than 1 micron, Brownian motion can suspend the particles, thereby eliminating any risk of the particles settling in the carrier medium. Thus, it is advantageous to have particles that remain suspended due to Brownian motion. In this regard, it is understood that particles significantly larger than the size required for Brownian motion are "super-Brownian", while particles equal to or smaller than the size for Brownian motion are "sub-Brownian", and those near the transition are "near-Brownian". The particle sizes at which these appellations apply depends on the relative densities of the particulate material and the carrier medium. The larger the density difference, the smaller the particle size required before this effect can take place.

The maximum settling rate allowable depends on factors such as the properties of the treating composition, and the conditions pertaining to its application—for example, whether the carrier medium is a liquid at ambient temperature, and if the composition might sit unused on a shelf for a variable length of time. The time before significant settling occurs may be referred to as the shelf life of the treating composition.

In applications where mixing, such as stirring or shaking, can redisperse settled particulate, the settling time is not a concern, provided that settling does not occur elsewhere in the system. The shelf life may be determined using Equation 1, given a definition of what is considered 'settled'—for example, a two inch distance in a container.

Thus the particle size, density difference, the viscosity of the carrier medium, as well as the rate at which a sump or storage area for the treating composition is depleted and refilled, can all affect the settling. Low viscosity carrier media, such as in the range of from about 100 cp to about 500 cp, will rapidly settle super-Brownian particles within hours, and near-Brownian particles in several days. Carrier media of moderate viscosity—e.g., of from about 501 cp to about 10,000 cp—may require weeks to settle near-Brownian particles. In carrier media of higher viscosity, even super-Brownian particles can remain suspended for weeks without noticeable settling.

Materials suitable for the particulate material of the invention include ceramics, metal oxides, such as $Al_2O_3$, and polymers, particularly plastics and elastomers. Amorphous silicas, including precipitated and fumed silicas, and crystalline silicas, also are appropriate. A commercially available $Al_2O_3$ which may be used is Al600, from Atlantic Equipment Engineers, Bergenfield, N.J. Commercially available fumed silicas which may be used are Cab-O-Sil® LM-130, Cab-O-Sil® TS-530, Cab-O-Sil® TS-720, and Cab-O-Sil® TS-730, all from Cabot Corporation, Tuscola, Ill.

Preferred materials for the particulate material of the invention include crosslinked polyorganosiloxanes, particularly crosslinked random polyorganosiloxanes. Crosslinked random polyorganosiloxane particulate material of the invention preferably is in the form of spherical particles, or at least near spherical, or at least essentially or at least substantially spherical particles; additionally the particles preferably are uniform, or at least nearly uniform, or at least essentially or at least substantially uniform.

The crosslinked random polyorganosiloxanes preferably comprise repeat units selected from the group consisting of $SiO_2$ and $RSiO_{1.5}$ repeat units, where R is a hydrocarbyl group. $R'_2SiO$ repeat units may also be included, with the two R' groups being the same or different hydrocarbyl groups.

Particularly as to the $SiO_2$ and $RSiO_{1.5}$ repeat units, for a particular crosslinked random polyorganosiloxane these may be all $SiO_2$ repeat units, or all $RSiO_{1.5}$ repeat units, or a combination of $SiO_2$ and $RSiO_{1.5}$ repeat units. In any of these instances, the $R'_2SiO$ repeat units as indicated may also be present.

For a polymer with $RSiO_{1.5}$ repeat units, R may be the same hydrocarbyl group for all of the $RSiO_{1.5}$ repeat units, or two or more different hydrocarbyl groups. For instance, the $RSiO_{1.5}$ repeat units may include both units where R is a methyl group and units where R is an ethyl group.

If $R'_2SiO$ repeat units are included, likewise all of these may be the same repeat unit, or different of the $R'_2SiO$ repeat units may have different R' groups. For instance, there may be units where both R' groups are methyl groups and units where both R' groups are ethyl groups; or in place of one of these types of units, or in addition to these two types of units, there may be units where one R' group is a methyl group and one R' group is an ethyl group.

For the R and R' groups, the preferred hydrocarbyl groups are the $C_1$–$C_{18}$ hydrocarbyl groups, particularly the $C_1$–$C_{18}$ alkyl groups, most particularly methyl and ethyl, and the phenyl, phenylpropyl, and phenylvinyl groups.

Especially preferred $RSiO_{1.5}$ repeat units are those where R is selected from the group consisting of methyl, ethyl, phenyl, phenylpropyl, and phenylvinyl. Especially preferred $R'_2SiO$ repeat units are the $(Me)_2SiO$, $(Et)_2SiO$, and MeEtSiO repeat units.

FIGS. 1–4 show idealized representations of the structures of crosslinked random polyorganosiloxanes suitable for the particulate material of the invention. It is understood that FIGS. 1–4 are not intended to be accurate representations of the complete structures of the indicated polymers.

Figure 2:
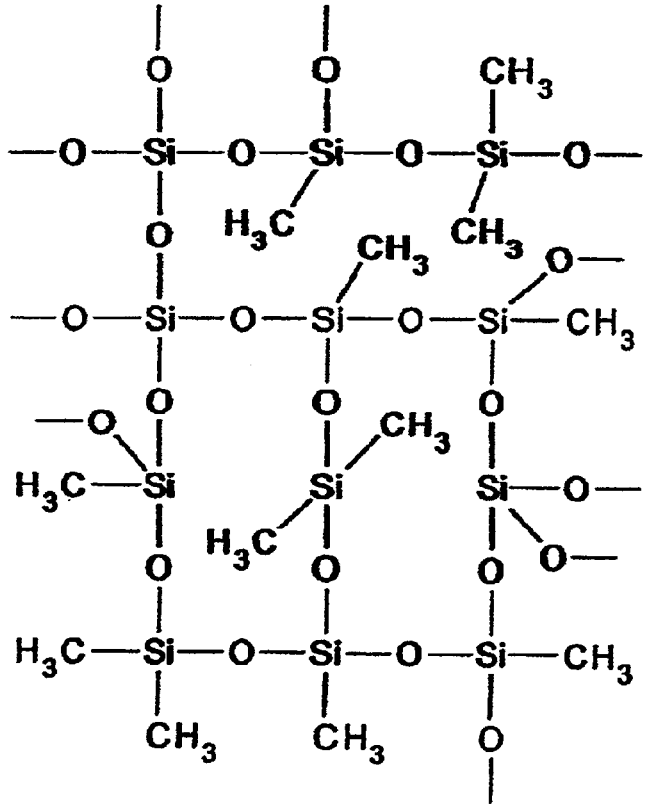
Figure 3:
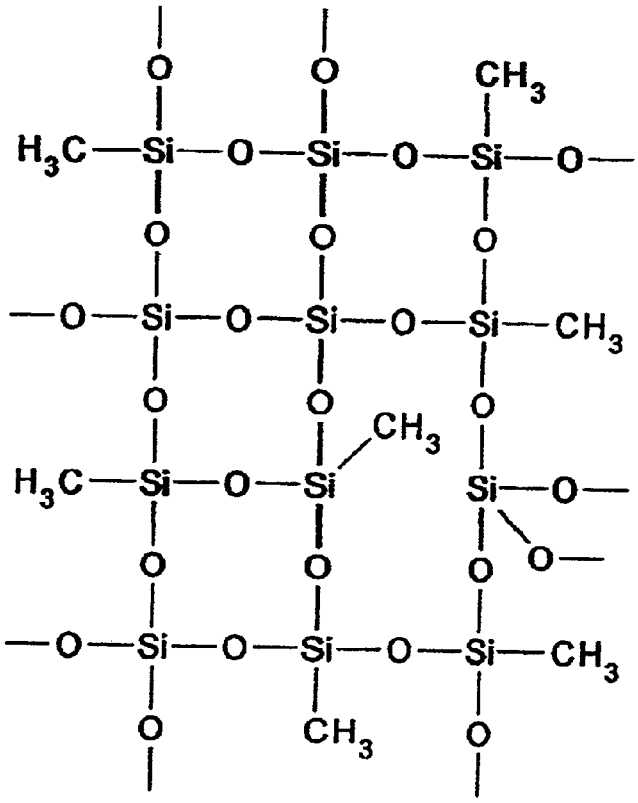
Figure 4:
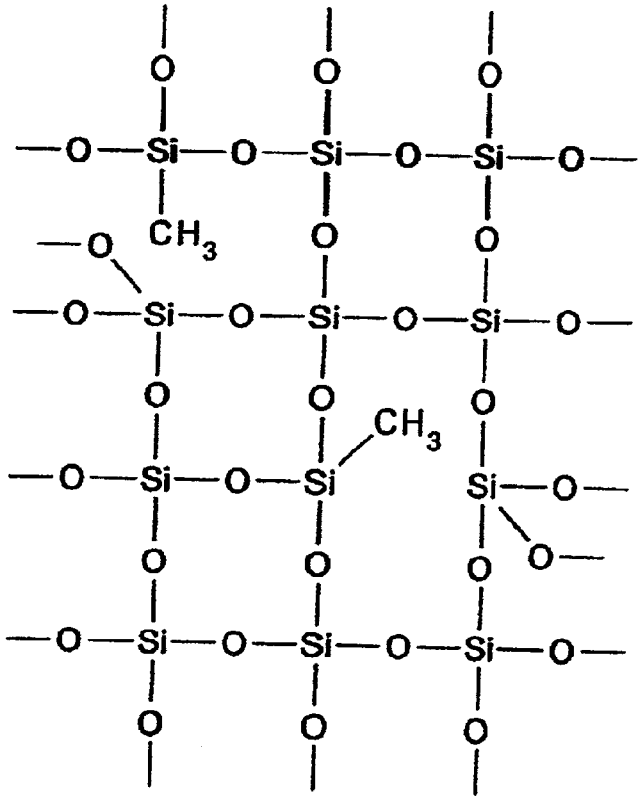

The polymer of FIG. 1 is made up of 100 mole percent $MeSiO_{1.5}$ repeat units. The polymer of FIG. 2 is 50 mole percent $MeSiO_{1.5}$ repeat units, 25 mole percent $(Me)_2SiO$ repeat units, and 25 mole percent $SiO_2$ repeat units. The polymer of FIG. 3 is 50 mole percent $MeSiO_{1.5}$ repeat units and 50 mole percent $SiO_2$ repeat units. The polymer of FIG. 4 is 84 mole percent $SiO_2$ repeat units and 16 mole percent $MeSiO_{1.5}$ repeat units.

It is understood that the crosslinked random polyorganosiloxanes may include, besides the three indicated repeat units, one or more other substituents, particularly one or more other repeat units, such as one or more other monomeric units. For instance, in the case of $SiO_2$, $RSiO_{1.5}$, and $R'_2SiO$ repeat units derived from monomers with multiple polymerization reactive moieties, for some portion of the monomer, not all of these moieties may have been reacted. As an example, in the case of tetramethoxysilane reacted to provide $SiO_2$ repeat units, some amount of the monomer may have only had three methoxy groups reacted, and/or there may have been a portion with only two reacted methoxy groups, etc.

The Q-resins, and the polysilsesquioxanes and T-resins, are suitable crosslinked random polyorganosiloxanes for the particulate material of the invention. The polysilsesquioxanes have a specific gravity of from about 1.0 gram/$cm^3$ to about 1.4 grams/$cm^3$. As to carrier media, the nonfunctional polydimethylsiloxane liquids that are typically used have a specific gravity of about 0.9 gram/$cm^3$ to about 0.98 gram/$cm^3$, with polyphenylmethylsiloxane and poly(phenylmethyl-co-diphenyl)siloxane copolymers being in the range of from about 1.1 grams/$cm^3$ to about 1.15 grams/$cm^3$. It is accordingly possible to lessen the difference between particulate material and carrier medium densities by using phenyl group-bearing polyorganosiloxanes—either alone, or together with nonfunctional polyorganosiloxanes, such as with the phenyl group-bearing polyorganosiloxanes serving as additives.

The polysilsesquioxanes in particular preferably are in the form of spherical particles, or at least near spherical, or at least essentially or at least substantially spherical particles, as well as preferably being uniform, or at least nearly uniform, or at least essentially or at least substantially uniform. Their relatively lower density is preferable to the higher densities of other spherical particulates, such as metal oxides.

Among the polysilsesquioxanes that may be used are the polymethylsilsesquioxanes, the polyphenylpropylsilsesquioxanes, the polyphenylsilsesquioxanes, and the polyphenylvinylsilsesquioxanes. Particularly, the polysilsesquioxanes and T-resins as disclosed in *Silicon Compounds: Register and Review*, 5th Edition, R. Anderson et al. (Eds.), United Chemical Technologies, p. 280 (1991), and in *Gelest—Silicon, Germanium, & Tin Compounds, Metal Alkoxides, Metal Diketonates, and Silicones*, p. 515 (1998), may be used; these publications are incorporated herein in their entireties, by reference thereto.

Polysilsesquioxane particulate materials, in the form of uniform spherical particles, are commercially available under the trademark Tospearl® from GE Silicones, Waterford, N.Y.; they include Tospearl® 105, Tospearl® 120, Tospearl® 130, Tospearl® 145, Tospearl® 240, and Tospearl® 3120, from GE Silicones, Waterford, N.Y. There are also such materials sold under the designations X-52-1186 and X-52-856 by Shin-Etsu Silicones of America, Inc., Akron, Ohio. These materials have high heat resistance, and they are readily wet by polyorganosiloxane release agents.

The shelf life of the treating composition of the invention may be easily determined, and one factor that may limit shelf life is the settling of the particulate. In this regard, the degree or extent of settling, as determined by the distance the particulate will travel in a given time under the influence of gravity, may be predicted by simple experimentation.

Particularly in the case of 2.0 micron diameter spherical particulate with a density of 1.35 grams/cm$^3$, such simple experimentation reveals that the rate of settling, in 1,000 cSt polydimethylsiloxane liquid, is 0.0000026 cm/sec. This rate in fact is 3 times as fast as is predicted by Equation 1, and this adjustment factor C may be included in Equation 1 to establish the desired carrier medium viscosity, particle size, and density difference for maintaining a desired shelf life.

Reducing Equation 1, including the adjustment factor C, results in the equation $$D=(2/9)CR^2Gt(\rho_s-\rho_f)/\mu \qquad \text{(Equation 2)}$$

where

D=Maximum settled distance t=Desired shelf life

For example, to allow no more than two inches of settling over a 30 day period, in a bottle containing, as the treating composition of the invention, a spherical particulate of 1.35 grams/cm$^3$ specific gravity dispersed in polydimethylsiloxane, the particle size and carrier medium viscosity should satisfy the equation $$7.9\cdot10^{-9}\ \text{cm}^3\cdot\text{seconds/grams} \geq R^2/\mu \qquad \text{(Equation 3)}$$

Thus, for particulate material with a specific gravity of about 1.35 grams/cm$^3$, in 1,000 cSt oil the particulate diameter should be about 1.8 $\mu$m or less, and in 60,000 cSt liquid the particulate diameter may be as large as about 13 $\mu$m. It is accordingly preferred that the particle radius, particle density, carrier medium density, and carrier medium viscosity, of the particulate material and the carrier medium, be selected so that the particulate material does not rapidly settle out of the carrier medium, and so that $R^2\cdot(\rho_s-\rho_f)/\mu$ be less than or equal to about $1\cdot10^{-8}$ seconds, more preferably less than or equal to about $5\cdot10^{-9}$ seconds, and still more preferably less than or equal to about $2\cdot10^{-9}$ seconds.

Another factor to consider, as to determining the size of the particulate material employed with the treating composition of the invention, is the material's intended function of preventing or limiting toner marking. Preferably, the particulate material is of a size that facilitates its performance of this function.

How the particulate material in fact performs its intended function of combating contact with other surfaces is not completely understood. It is thought that the material serves in the manner of spacers, or surface-separating braces or supports, or as rolling slip agents in the manner of antifriction elements like ball bearings, or by a combination of these mechanisms. Whatever mechanism or mechanisms actually are involved, this explanation is provided only for the purpose of discussing the invention as fully as possible according to the best current understanding thereof, and it is not to be considered as limiting the scope of the invention.

In any event, the effectiveness of the particulate material as an agent against toner marking depends on several factors, including the particle size of the material, its population density (also referred to herein as coverage) on the surface of the deposited toner, the roughness of this surface, and the roughness of the abrading surface.

Likewise there are several sources that contribute to the surface roughness of toner residing on the substrate surface. For instance, while the mechanism is not entirely understood, it is thought that the fuser member imparts an imprint of the fuser surface roughness on the toner. In addition, particularly in the case of paper, the substrate on which the toner is deposited itself can have a degree of surface roughness; for paper this roughness is due to paper fibers. Moreover, the shape of the toner prior to fusing may remain, to some extent, in the fused toner surface. All of the foregoing contribute to the roughness of the surface of the toner. This roughness is provided in the form of ridges and crevices on the toner surface, resulting in a rough surface that is susceptible to toner marking.

If too high a proportion of the particulate material slips too far into the toner surface crevices, the material will not be effective for combating contact of the toner—particularly, its peaks—with the contacting surface. The minimum acceptable particle size depends on the roughness of the surface of the toner to which it is applied. Preferably, the particulate material has a mean particle diameter which is at least about one eighth of the average roughness ($r_a$) of the toner surface.

Typical rates for application of treating composition to substrate, in the case of paper, are less than 30 microliters ($\mu$l) per 8½" by 11" sheet. Treating composition application rates are limited by unwanted side effects, such as oil streaks, machine contamination during duplex printing, and oil spots.

Table 1 shows, in particles per cm$^2$, the calculated coverage—i.e., the coverage obtained—at a treating composition application rate of 2 $\mu$l per 8.5 by 11 inch sheet, and for the different particulate material sizes (in mean particle diameter) and concentrations of particulate material in carrier medium (in parts of material per 100 parts by weight of carrier medium) as are provided.

TABLE 1

| Mean particle diameter | 1 pph | 5 pph | 10 pph |
|---|---|---|---|
| 2 $\mu$m | 5770 | 28,000 | 54,000 |
| 4.5 $\mu$m | 510 | 2460 | 5750 |
| 12 $\mu$m | 26.7 | 130 | 250 |

Particulate material sizes larger than the indicated one eighth of toner surface $r_a$ may be more effective. However, as shown in Table 1, coverage drops substantially as particle size increases.

Increasing the application rate of the treating composition will increase the coverage. The minimum effective coverage is about 1,000 particles per cm$^2$. Optimal coverage in particular instances depends upon such factors as the properties of the toned image—particularly, of the toner residing on the substrate surface—and on the size of the particulate material. These can be varied by one of ordinary skill in the art, without requiring undue experimentation, so as to achieve the maximum benefit at a minimum of additional expense.

Besides treating composition application rate, the concentration of the particulate material in the treating composition can also be used to control coverage. However, increasing particulate concentration will increase treating composition viscosity. And at excessively high concentrations, the zero shear viscosity of the treating composition likewise becomes undesirably high, so that the treating composition no longer flows sufficiently freely (e.g., at sufficient velocity), or even no longer flows at all, under the influence of gravity.

Considering the foregoing, preferably the treating composition of the invention has a zero shear viscosity of not more than about 250,000 cp under use conditions. With particulate concentration being a factor that affects zero shear viscosity, correspondingly the concentration of the particulate material in the carrier medium does not exceed the point at which zero shear viscosity would be more than about 250,000 centistokes under use conditions.

In addition to preferably having a zero shear viscosity of less than about 250,000 cp under use conditions, also as a matter of preference the concentration of particulate material in the treating composition is not more than about 80 parts of particulate per 100 parts by weight of carrier medium—i.e., not more than about 80 pph particulate. More preferably this concentration of particulate material is from about 0.1 pph to about 80 pph particulate. The particulate accordingly, as a matter of preference, can be present in a concentration of up to about 80 pph, as long as zero shear viscosity is not more than about 250,000 cp.

In the embodiment, as discussed, where the treating composition is employed as a toner fusing system release agent, the composition is applied to the surface of the fuser member, so that during the fusing process the composition contacts toner on the substrate, and can also contact the substrate; particulate material is accordingly transferred, preferably along with release agent carrier medium, to the thusly contacted surface, when the toner is fused to the substrate by the composition-treated fuser member. During the operation of the toner fusing system, preferably the treating composition is applied continuously, or at least essentially continuously, or at least substantially continuously, to the fuser member surface.

The treating composition may be applied to the fuser member by any suitable applicator, including treating composition soaked web or impregnated roll. Preferably a means that provides the indicated continuous application, such as a rotating wick oiler or a donor roller oiler, is employed.

A rotating wick oiler comprises a storage compartment for the treating composition and a wick for extending into this compartment. During operation of the toner fusing system of the invention, the wick is situated so as to be in contact with the stored treating composition and also with the fusing surface layer of the fuser member; the wick thusly picks up treating composition and transfers it to the fuser member.

A donor roller oiler is an applicator which includes the following: a metering roller, for taking up the treating composition from its supply source; a metering blade, which can be a rubber, plastic, or metal blade, for skimming excess treating composition from the metering roller; and a delivery roller, for receiving treating composition from the metering roller, and contacting the fuser member surface to apply treating composition thereon.

Where the applicator is a rotating wick oiler, the average pore size of the wick must not be so small as to interfere with the delivery of the particulate material incorporated in the treating composition. If the size distribution of the particles and the wick pore size overlap, blocking of the wick could occur. Similarly, for a donor roller oiler, the gap between the metering blade and the metering roller determines the maximum size of the particles in the size distribution.

In the embodiment where the treating composition is employed in a step or process separate from the fusing process, application of the treating composition occurs at a different station or location from that at which fusing is effected. The composition could be applied immediately after the fusing, while the toner is still in a molten state, or substantially after fusing. Preferably, the separate step or process as indicated is conducted at an ambient temperature.

Where fusing temperatures thusly are not employed for this embodiment, the temperature resistance properties that apply when the treating composition is employed during fusing are not a consideration. Accordingly the particulate material need not be heat stable within the temperature ranges as discussed, and heat stability, as has been noted, also is not a necessity for the carrier medium.

Means of application suitable for use with the fusing process also may be employed here. Preferred are the rotating wick oiler and donor roller oiler as discussed. If required, internal and external heating means, as are known in the art, also may be used.

The invention is illustrated by the following procedures; these are provided for the purpose of representation, and are not to be construed as limiting the scope of the invention. Unless stated otherwise, all percentages, parts, etc. are by weight.

Experimental Procedures

Materials Employed in the Procedures

Polydimethylsiloxane surface-treated fumed $SiO_2$, irregularly shaped particulate with approx. 0.2 microns mean particle diameter(Cab-O-Sil® TS-720), from Cabot Corporation $Al_2O_3$, irregularly shaped particulate with approx. 1–2 micron mean particle diameter (Al600), from Atlantic Equipment Engineers Tospearl® 105 (approx. 0.5 microns mean particle diameter), Tospearl® 120 (approx. 2 microns mean particle diameter), Tospearl® 145 (approx. 4.5 microns mean particle diameter), and Tospearl® 3120 (approx. 12 microns mean particle diameter) polysilsesquioxane spherical particulate, from GE Silicones 1,000 and 60,000 centistoke DC200 polydimethylsiloxane (PDMS), from Dow Corning Corporation EC4952 65 Shore A condensation cure RTV silicone rubber, from Emerson & Cuming ICI, Billerica, Mass.

LS4340-104 condensation cure RTV silicone rubber, from Emerson & Cuming ICI

Catalyst 50, from Emerson & Cuming ICI

Preparation of Treating Compositions

Particulate-containing silicone liquid compositions were prepared in accordance with the data set forth in Table 2. In each instance, the indicated particulate and polydimethylsiloxane, in the amounts as stated, were combined, and mixed by hand to form a blend, with air bubbles being removed by vacuum.

At all of the specified concentrations, the Tospearl® 105 appeared to be stable against settling. In 1,000 centistoke silicone liquid, the Tospearl® 120 was seen to settle over a period of weeks. In 60,000 centistoke liquid, the Tospearl® 120, Tospearl® 145, Tospearl® 3120, silica, and alumina, at all concentrations, exhibited no significant settling for several weeks.

TABLE 2

| Particulate Type | PDMS viscosity (cSt) | Particle Size | PPH Particulate | Grams Particulate | Grams PDMS | Blend Viscosity (cp)** |
|---|---|---|---|---|---|---|
| Tospearl ® 105 | 60,000 | 0.5 μm | 1 | .25 | 25.5 | 63,250 |
| Tospearl ® 105 | 60,000 | 0.5 μm | 2 | .5 | 25.5 | 65,000 |
| Tospearl ® 105 | 60,000 | 0.5 μm | 5 | 1.25 | 25.5 | 70,500 |
| Tospearl ® 105 | 60,000 | 0.5 μm | 6 | 1.52 | 25.5 | 76,500 |
| Tospearl ® 105 | 60,000 | 0.5 μm | 10 | 2.55 | 25.5 | 81,500 |
| Tospearl ® 120 | 60,000 | 2 μm | 1 | .25 | 25.5 | — |
| Tospearl ® 120 | 60,000 | 2 μm | 5 | 1.25 | 25.5 | 67,500 |
| Tospearl ® 120 | 60,000 | 2 μm | 10 | 2.55 | 25.5 | 75,500 |
| Tospearl ® 145 | 60,000 | 4.5 μm | 1 | .25 | 25.5 | 63,500 |
| Tospearl ® 145 | 60,000 | 4.5 μm | 5 | 1.25 | 25.5 | 67,500 |
| Tospearl ® 145 | 60,000 | 4.5 μm | 6 | 1.5 | 25.5 | 70,000 |
| Tospearl ® 145 | 60,000 | 4.5 μm | 10 | 2.55 | 25.5 | 73,500 |
| Tospearl ® 145 | 60,000 | 4.5 μm | 12 | 3.0 | 25.4 | 77,000 |
| Tospearl ® 3120 | 60,000 | 12 μm | 1 | 0.25 | 25.5 | — |
| Tospearl ® 3120 | 60,000 | 12 μm | 5 | 1.25 | 25.5 | 67,250 |
| Tospearl ® 3120 | 60,000 | 12 μm | 10 | 2.55 | 25.5 | 72,500 |
| Tospearl ® 3120 | 1,000 | 2 μm | 5 | 1.25 | 25.5 | — |
| Fumed silica | 60,000 | 0.2 μm | 1.69* | 0.25 | 25.4 | — |
| Al600 | 60,000 | 2 μm | 3* | 0.25 | 25.4 | — |

*Equivalent in volume fraction to 1 pph Tospearl ® particulate
**Measured using a Brookfield Viscometer, from Brookfield Engineering Laboratories, Stoughton, MA
— Not measured Determining Effectiveness for Combating Toner Marking Certain of the foregoing treating compositions, and also polydimethylsiloxane liquid without particulate material incorporated therein, were tested for effectiveness in inhibiting toner marking. An offline fuser, with a pressure roller having an aluminum core and a hard PFA surface layer, was employed for this purpose. The testing was conducted with fuser rollers, treating compositions, and polydimethylsiloxane liquid as identified in Examples 1–4 and Comparative Examples 1–9.

In each instance the fuser roller being used was placed in the offline fuser; a controlled amount of the treating composition, or the unmodified liquid, was applied to the fuser roller using a q-tip, and the fuser roller was rotated until the coating was uniform. The fuser was operated at 176.67° C., with the rollers rotating at a speed of 7 inches per second.

Four sheets of paper were passed through the fuser to deplete the oil film, followed by two toner-bearing sheets taken to evaluate for marking. The toned sheets employed a styrene-butylacrylate toner, at a laydown of 1.0 to 1.25 mg per $cm^2$.

Each of the two toned sheets was conditioned by being placed against a fresh sheet for 48 hours to absorb excess oil. Then each of the two sheets was placed face down on a clean sheet, under a 4.14 kg circular weight having a one inch diameter.

The clean sheet was pulled to evaluate the toner marking. The level of toner marking was measured by taking five reflection density measurements in the one inch diameter contact area, as defined by the indicated weight, of the untoned, pulled sheet. These measurements were made using an X-Rite 310 Photographic Densitometer, from X-Rite Incorporated, Grandville, Mich.

The two measurements were averaged, with the results for Examples 1–3 and Comparative Examples 4–8 being set forth in Table 3, and those for Example 4 and Comparative Example 9 being set forth in Table 4. Higher numbers indicate more transfer of toner, and a greater tendency to cause toner marking.

EXAMPLES 1–2

A fuser roller from an Imagesource 110 electrostatographic copier, from Heidelberg Digital L.L.C., Rochester, N.Y., was used to test treating compositions of 1 pph, 5 pph, and 10 pph Tospearl® 145, each in 60,000 cSt silicone liquid (Example 1), and 1 pph, 5 pph, and 10 pph Tospearl® 120, each also in 60,000 cSt silicone liquid (Example 2). The fuser roller had an aluminum core and a soft silicone surface layer.

EXAMPLE 3

A treating composition of 3 pph Al600 $Al_2O_3$ in 60,000 cSt silicone liquid was tested in the same manner as the compositions of Examples 1 and 2. The amount of $Al_2O_3$ provided was for the purpose of matching 1 pph Tospearl® particulate equivalent. In this regard, with the Al600 having a specific gravity of 3.9 g/$cm^3$, 3 parts of this $Al_2O_3$ per 100 parts by weight of the polydimethylsiloxane rendered the same volume fraction particulate as 1 part Tospearl® per 100 parts of the liquid.

COMPARATIVE EXAMPLES 1–2

Treating compositions of 1 pph, 5 pph, and 10 pph Tospearl® 3120, each in 60,000 cSt silicone liquid (Comparative Example 1), and 1 pph, 5 pph, and 10 pph Tospearl® 105, each also in 60,000 cSt silicone liquid (Comparative Example 2), were tested in the same manner as the compositions of Examples 1 and 2.

COMPARATIVE EXAMPLE 3

A treating composition of 60,000 cSt silicone liquid containing 1 pph Tospearl® particulate equivalent of Cab-O-Sil® TS-720 fumed silica (0.4297 g in 25.4 g PDMS) was tested in the same manner as the compositions of Examples 1 and 2.

COMPARATIVE EXAMPLES 4–8

60,000 cSt silicone liquid without particulate material was tested in the same manner as the compositions of Examples 1 and 2. The procedure was performed four times.

TABLE 3

Toner Marking Density Using a Ground Silicone Roller

| | 0 pph | 1 pph | 5 pph | 10 pph |
|---|---|---|---|---|
| Ex. 1 (Tospearl ® 145) | — | .28 | .24 | .2 |
| Ex. 2 (Tospearl ® 120) | — | .22 | .2 | .2 |
| Ex. 3 (Al600) | — | .18 | * | * |
| Comp. Ex. 1 (Tospearl ® 3120) | — | .3 | .3 | .28 |
| Comp. Ex. 2 (Tospearl ® 105) | — | .28 | .32 | .28 |
| Comp. Ex. 3 (Fumed Silica) | — | .27 | * | * |
| Comp. Ex. 4 | .25 | — | — | — |
| Comp. Ex. 5 | .24 | — | — | — |
| Comp. Ex. 6 | .26 | — | — | — |
| Comp. Ex. 7 | .24 | — | — | — |
| Comp. Ex. 8 | .28 | — | — | — |

*Not tested
Not applicable

EXAMPLE 4

Treating compositions of 1 pph, 5 pph, and 10 pph Tospearl® 120, each in 60,000 cSt silicone liquid, were tested using a fuser roller having a smooth silicone surface layer. This fuser roller was prepared in the following manner.

Specifically, an Imagesource 110 fuser roller was wiped with isopropanol. 1500 g Al600 $Al_2O_3$ was oven dried at 260° C. for 96 hours, and thereafter combined with 738 g LS4340-104. The composition of Al600 and LS4340-104 was milled on a three roll mill at 23° C. until uniform. A portion of the resulting mixture (70 g) was dispersed in 70 g of methyl ethyl ketone (MEK), and then Catalyst 50 was added (0.058 g). The resulting solution was filtered, degassed, and coated onto the fuser roller, which then was cured at 232° C. for 18 hours.

COMPARATIVE EXAMPLE 9

60,000 cSt silicone liquid without particulate material was tested in the same manner as the compositions of Example 4.

TABLE 4

Toner Marking Density Using a Smooth Silicone Roller

| | 0 pph | 1 pph | 5 pph | 10 pph |
|---|---|---|---|---|
| Ex. 4 (Tospearl ® 120) | — | .08 | .06 | .05 |
| Comp . Ex. 9 | .14 | — | — | — |

The Table 3 toner marking values demonstrate that the 2 micron Tospearl® 120 particulate was effective for reducing toner marking at all of the concentration levels tested. However, the 4.5 micron Tospearl® 145 particulate was effective only at the higher concentrations.

As shown in Table 1, there is a tradeoff between higher population density and increasing the size of the particulate material. The 4.5 micron Tospearl® at 10 pph, and the 2 micron Tospearl® at 1 pph, provide equivalent numbers of particles per unit of area.

As expected, at equivalent coverage the larger particle size material performed slightly better. The population density obtained with the larger Tospearl® 3120 was insufficient, while the 0.5 micron particle size of the Tospearl® 105 material was too small, given the toner surface roughness produced by the ground surface layer of the Imagesource 110 fuser roller. Likewise in accordance with Table 3, effective results were obtained with the Al600 $Al_2O_3$ 1–2 micron irregularly shaped particulate.

The results listed in Table 4 demonstrate that where a roller with a smooth surface is employed, the particulate is even more effective at reducing the level of toner marking.

As can be seen from the foregoing, the compositions and processes of the invention effect a reduction in the degree of toner marking. Further, resistance to marking remains after the carrier liquid has wicked away from the toner and substrate surface.

Finally, although the invention has been described with reference to particular means, materials, and embodiments, it should be noted that the invention is not limited to the particulars disclosed, and extends to all equivalents within the scope of the claims.

What is claimed is:

1. A composition for application to toner residing on a substrate surface, comprising:

(a) Particulate material for combating contact between the toner and abrading surfaces; and (b) at least one carrier medium for the particulate material.

2. The composition of claim 1, wherein the carrier medium comprises a release agent.

3. The composition of claim 2, wherein the release agent comprises a polyorganosiloxane.

4. The composition of claim 3, wherein the polyorganosiloxane comprises a nonfunctional polyorganosiloxane.

5. The composition of claim 4, wherein the nonfunctional polyorganosiloxane comprises a nonfunctional polydimethylsiloxane.

6. The composition of claim 3, wherein the polyorganosiloxane has a viscosity of from about 150 cp to about 100,000 cp.

7. The composition of claim 1, wherein the particulate material consists essentially of particles that have an aspect ratio of about 3 or less.

8. The composition of claim 7, wherein the particulate material consists essentially of particles that are at least nearly uniform in size.

9. The composition of claim 1, wherein the particulate material has a mean particle diameter of from about 0.5 to about 12 microns.

10. The composition of claim 1, wherein the carrier medium has a specific gravity of from about 0.7 gram/$cm^3$ to about 1.8 grams/$cm^3$.

11. The composition of claim 1, wherein the particulate material has a specific gravity of from about 0.5 gram/$cm^3$ to about 5 grams/$cm^3$.

12. The composition of claim 1, wherein the ratio of the particulate material specific gravity to the carrier medium specific gravity is from about 0.5:1 to about 5:1.

13. The composition of claim 1, wherein $$R^2\cdot(\rho_s-\rho_f)/\mu \leq \text{about } 1\cdot 10^{-8} \text{ seconds}$$

where

R=particle radius;

$\rho_s$=particle density;

$\rho_f$=carrier medium density; and $\mu$=carrier medium viscosity.

14. The composition of claim 1, wherein the particulate material comprises at least one member selected from the group consisting of ceramics, metal oxides, silica, and polymers.

15. The composition of claim 14, wherein the particulate material comprises a crosslinked random polyorganosiloxane comprising repeat units selected from the group consisting of $SiO_2$ and $RSiO_{1.5}$ repeat units, where R is a hydrocarbyl group.

16. The composition of claim 15, wherein the crosslinked random polyorganosiloxane further comprises $R'_2SiO$ repeat units, where the two R' groups are the same or different hydrocarbyl groups.

17. The composition of claim 15, wherein the crosslinked random polyorganosiloxane is a polysilsesquioxane.

18. The composition of claim 17, wherein the polysilsesquioxane consists essentially of particles that have an aspect ratio of about 2 or less and that are at least nearly uniform in size.

19. The composition of claim 18, wherein the polysilsesquioxane has a mean particle diameter of from about 0.5 to about 6 microns.

20. The composition of claim 19, wherein the carrier medium has a specific gravity of from about 0.7 gram/cm$^3$ to about 1.8 grams/cm$^3$, and the polysilsesquioxane has a specific gravity of from about 0.5 gram/cm$^3$ to about 2.7 grams/cm$^3$.

21. The composition of claim 19, wherein the ratio of the polysilsesquioxane specific gravity to the carrier medium specific gravity is from about 0.5:1 to about 3.2:1.

22. The composition of claim 21, wherein the particulate material and the carrier medium have about the same specific gravity.

23. The composition of claim 19, wherein $$R^2\cdot(\rho_s-\rho_f)/\mu \leqq \text{about } 5\cdot10^{-9} \text{ seconds}$$

where

R=particle radius;

$\rho_s$=particle density;

$\rho_f$=carrier medium density; and $\mu$=carrier medium viscosity.

24. A process for fusing toner residing on a substrate surface to the substrate surface, the process comprising:

(a) applying, to the surface of a fuser member, a composition comprising (i) at least one release agent; and (ii) particulate material; and (b) contacting the toner with the fuser member surface bearing the composition.

25. The process of claim 24, wherein the particulate material is for combating contact between the toner and abrading surfaces.

26. The process of claim 24, comprising providing the surface of the toner with a particulate material population density of at least about 1,000 particles per cm$^2$.

27. The process of claim 26, wherein the particulate material has a mean particle diameter of at least about one eighth of the average roughness of the surface of the toner.

28. The process of claim 27, wherein the release agent comprises a polyorganosiloxane.

29. The process of claim 28, wherein the particulate material comprises at least one member selected from the group consisting of ceramics, metal oxides, silica, and polymers.

30. The process of claim 29, wherein the particulate material comprises a polysilsesquioxane, and wherein the polysilsesquioxane consists essentially of particles that have an aspect ratio of about 2 or less and that are at least nearly uniform in size.

31. The process of claim 30, wherein the polysilsesquioxane has a mean particle diameter of from about 0.5 to about 6 microns and a specific gravity of from about 0.5 gram/cm$^3$ to about 2.7 grams/cm$^3$, the release agent has a specific gravity of from about 0.7 gram/cm$^3$ to about 1.8 grams/cm$^3$, and the ratio of the particulate material specific gravity to the release agent specific gravity is from about 0.5:1 to about 3.2:1.

32. The process of claim 31, wherein $$R^2\cdot(\rho_s-\rho_f)/\mu \leqq \text{about } 1\cdot10^{-8} \text{ seconds}$$

where

R=particle radius;

$\rho_s$=particle density;

$\rho_f$=release agent density; and $\mu$=release agent viscosity.

33. A process for combating toner marking comprising applying, to the surface of toner previously fused to a substrate surface, a composition comprising:

(a) at least one carrier medium; and (b) particulate material.

34. The process of claim 33, wherein the particulate material is for combating contact between the toner and abrading surfaces.

35. The process of claim 33, comprising providing the surface of the toner with a particulate material population density of at least about 1,000 particles per cm$^2$.

36. The process of claim 35, wherein the particulate material has a mean particle diameter of at least about one eighth of the average roughness of the surface of the toner.

37. The process of claim 36, wherein the carrier medium comprises a polyorganosiloxane.

38. The process of claim 36, wherein the particulate material comprises a crosslinked random polyorganosiloxane comprising repeat units selected from the group consisting of $SiO_2$ and $RSiO_{1.5}$ repeat units, where R is a hydrocarbyl group.

39. The process of claim 38, wherein the crosslinked random polyorganosiloxane consists essentially of particles that have an aspect ratio of about 2 or less and that are at least nearly uniform in size.

40. The process of claim 39, wherein the crosslinked random polyorganosiloxane has a mean particle diameter of from about 0.5 to about 6 microns and a specific gravity of from about 0.5 gram/cm$^3$ to about 2.7 grams/cm$^3$, the carrier medium has a specific gravity of from about 0.7 gram/cm$^3$ to about 1.8 grams/cm$^3$, and the ratio of the particulate material specific gravity to the carrier medium specific gravity is from about 0.5:1 to about 3.2:1.

41. The process of claim 40, wherein $$R^2\cdot(\rho_s-\rho_f)/\mu \leqq \text{about } 1\cdot10^{-8} \text{ seconds}$$

where

R=particle radius;

$\rho_s$=particle density;

$\rho_f$=carrier medium density; and $\mu$=carrier medium viscosity.

42. The process of claim 33, further comprising, prior to applying the composition, fusing the toner to the substrate surface.

43. The process of claim 42, wherein the fusing of the toner to the substrate surface comprises contacting the toner with the surface of a fuser member as the toner resides on the substrate surface.

* * * * *